United States Patent [19]

Watanabe et al.

[11] 4,150,620

[45] Apr. 24, 1979

[54] INK MIST TYPE HIGH SPEED PRINTER

[75] Inventors: Akinori Watanabe; Katsuhide Tanoshima; Matsusaburo Noguchi, all of Tokyo, Japan

[73] Assignee: Oki Electric Industry Co., Ltd., Tokyo, Japan

[21] Appl. No.: 770,626

[22] Filed: Feb. 22, 1977

[30] Foreign Application Priority Data

Feb. 26, 1976 [JP] Japan ..... 51-019429

[51] Int. Cl.[2] ..... B41F 15/00; G03G 21/00

[52] U.S. Cl. ..... 101/114; 101/DIG. 13; 250/324; 346/159

[58] Field of Search ..... 346/75, 159; 101/114, 101/1, DIG. 13; 250/324, 325

[56] References Cited

U.S. PATENT DOCUMENTS

| | | | |
|---|---|---|---|
| 3,578,970 | 5/1971 | Michaud | 250/325 |
| 3,943,848 | 3/1976 | Watanabe | 101/114 |
| 4,013,004 | 3/1977 | Watanabe | 101/1 |
| 4,068,585 | 1/1978 | Thompson | 101/114 |

*Primary Examiner*—Joseph W. Hartary
*Attorney, Agent, or Firm*—Peter L. Berger

[57] ABSTRACT

This invention provides an ink mist type high speed printer in which an aperture board is provided between a first electrode and a second electrode across which a high voltage is applied. The aperture board is adapted to selectively control passage of ions generated from the second electrode, and a stream of ink mist is passed between said aperture board and first electrode so that the ions which have passed said aperture board will electrically charge the ink mist particles selectively to let the electrically charged ink mist particles deposit on a recording paper placed between the ink mist and first electrode to thereby print the desired dot matrix characters. This invention also features provision of electrostatic shields placed between said first electrode and ink mist stream and at places outside of the desired printing space to guard the aperture board against deposition of ink mist particles.

4 Claims, 5 Drawing Figures

INK MIST TYPE HIGH SPEED PRINTER

BACKGROUND OF THE INVENTION

This invention relates to an ink mist type high speed printer.

Speed-up of the central processors in the electronic computer systems is necessitating corresponding speed-up of the printers which are output terminal units of such computer system. There are known various types of high speed printers, and among them is a so-called ink mist type high speed printer in which the ink mist particles electrically charged by ions are moved toward a printing paper to print desired characters by way of dot matrices on the printing paper. More particularly, according to such ink mist type printer, the ink mist particles in a stream of ink mist are selectively charged by cations which move from a second positive electrode to a first negative electrode in a back bar through an aperture board, and the electrically charged ink mist particles are carried by electrostatic force toward a recording paper placed between the stream of ink mist and back bar to thereby print characters by way of dot matrices on the recording paper.

The said type of high speed printer is usually so designed as to permit printing of 132 to 136 characters (letters, etc.) on each line. Therefore, when using a recording paper with a narrow printing space, no shield is present between the back bar and stream of ink mist in the area outside of the space of the printing paper. In such a case, if insulating dust such as flocks of the recording paper should contact the back bar which is a negative pole, such dust is charged negative and attracted toward the aperture board which is relatively high potential to the back bar. As such dust passes through the stream of ink mist, the dust particles carry the ink mist particles therewith, causing ink to adhere to the aperture board. Also, if such dust is loaded with ink to become insulating and deposits on the back bar, there takes place concentration of the electric field in the vicinity of said dust to cause discharge between the back bar and aperture board to anionize air in the neighborhood of said dust. These anions are also attracted to the aperture board, so that they pass through the laminar stream of ink mist to electrically charge the ink mist particles, causing deposition of ink on the aperture board.

Such deposition of ink on the aperture board leads to various troubles. For example, the cation outlet may be clogged, or the common electrode provided on the front side of the aperture board and the control electrodes provided on the back side thereof may be brought into a conductive state to retard the function of controlling passage of cations.

SUMMARY OF THE INVENTION

The present invention is intended to provide an ink mist type high speed printer in which the area outside of the printing space of the recording paper and the exposed portion of the first electrode of the back bar are covered by electrostatic shields each of which is composed of an insulating plate and a conductive plate joined integral with each other, thereby to reduce or eliminate the electrostatic field between the electrostatic shields and aperture board so that the dust deposited on the first electrode of the back bar will not be carried to the aperture board, thereby preventing said aperture board from being soiled with ink mist particles.

OBJECTS OF THE INVENTION

The first object of this invention is to provide an ink mist type high speed printer in which electrostatic shields are provided between a first electrode and a stream of ink mist in such a manner as to cover the area outside of the printing space of the recording paper and the part of the first electrode not covered with the recording paper, thereby preventing the dust particles on the first electrode from migrating to the aperture board.

The second object of this invention is to keep the aperture board from being soiled with ink by inhibiting migration of dust on the first electrode toward the aperture board.

The third object of this invention is to keep the cation outlet of the aperture board from being clogged with ink or dust.

The fourth object of this invention is to eliminate the possibility that the common electrode provided on the front side of the aperture board and the control electrodes provided on the back side thereof be brought into a conductive state by deposition of ink or dust to obstruct the cation passage controlling function.

The fifth object of this invention is to ensure covering of the area outside of the printing space of the recording paper and the part of the first electrode not covered with the recording paper, by connecting the electrostatic shields with corresponding tractors adapted to feed the recording paper.

The sixth object of this invention is to allow mounting and demounting of the electrostatic shield to and from the back bar by designing said shield in the form of a mask having a window according to a desired printing format.

DETAILED DESCRIPTION OF THE INVENTION

Figure 1:
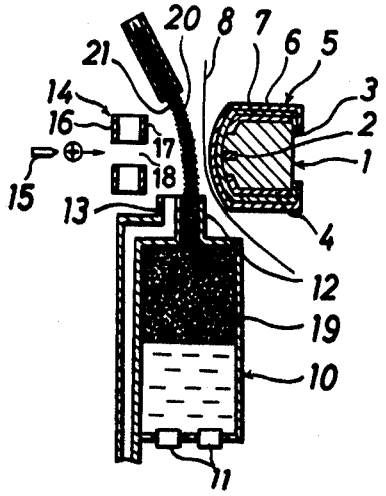
FIG. 1 is an illustrative cross-sectional view showing an embodiment of the present invention.

Referring first to FIG. 1, numeral 1 indicates generally a back bar consisting of a first electrode 2 connected to a negative electric source (5–6KV), not shown, an insulator 3 adapted to support and electrically insulate said first electrode 2 from other parts, and a grounded conductor 4 provided on the front side of said insulator 3. Numeral 5 denotes electrostatic shields each of which consists of a grounded conductor plate 6 and an insulating plate 7 disposed between said conductor plate 6 and back bar 1. Said electrostatic shields are adapted to be slidable on the back bar 1.

Designated by numeral 8 is a recording paper which is fed at high speed by tractor means 9 (See FIG. 3) disposed in front of the back bar and the electrostatic shields 5. Numeral 10 indicates an ink tank provided with supersonic vibrator means 11 at the bottom and a nozzle-like air outlet 13 in close proximity to an ink mist discharge port 12. Numeral 14 is an aperture board comprising a common electrode 17, selection electrodes 16 and a plurality of apertures 18 and arranged such that the cations produced from a second electrode 15 connected to a positive electric source (4-5KV) are allowed to pass the apertures 18 only when the selection electrodes 16 are at earth potential or at a positive potential relative to the common electrode 17 which has a low positive potential. Also in the drawing, numeral 19 refers to ink mist, 20 a stream of ink mist, and 21 a mist suction port.

Now the operation of the just described embodiment of this invention is explained.

Figure 2:
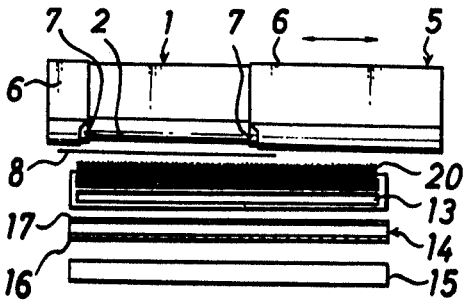
FIG. 2 is a diagramatic plane view of the mechanism shown in FIG. 1, with the ink mist suction port being removed.

When the supersonic vibrators 11 are operated to vibrate ink in the ink tank 10 to produce ink mist 19, such ink mist is carried on the air flow from the nozzle-like air outlet 13 while forming a stream 20 and taken into the mist suction port 21. In the meantime, a high voltage is applied between both electrodes 2 and 15, and the cations generated from the second electrode 15 pass selectively the aperture board 14, and when passing through the stream 20 of ink mist flowing in a curtain like form in front of the recording paper 8, said cations electrically charge the ink mist particles selectively and deposit on the recording paper to form a dot character at a predetermined position on said recording paper 8. In this case, if the width of the recording paper 8 is so narrow that it cannot cover the entire span of the first electrode 2 of the back bar 1, the electrostatic shields 5 are moved to the suitable positions to cover the exposed portion of the back bar 1 as shown in FIG. 2, so that the first electrode is covered along its full width by the recording paper 8 and electrostatic shields 5. Therefore, even if flocks of the recording paper 8 or other dust should adhere to the first electrode 2, no discharge is caused since the electrostatic shields 5 and the common electrode 17 of the aperture board 14 retain the same level of potential or have a potential difference, if any, of only an insignificant degree. There is also no possibility that insulating dust deposited and electrically charged on the conductor plate 6 of each electrostatic shield 5 be urged to fly to the aperture board 14. In the embodiment shown in FIG. 2, the electrostatic shields 5 are arranged slidable relative to the back bar 1 in conformity to the width of the recording paper 8, so that the shield on the right side can move sidewise as shown by arrows.

Figure 3:
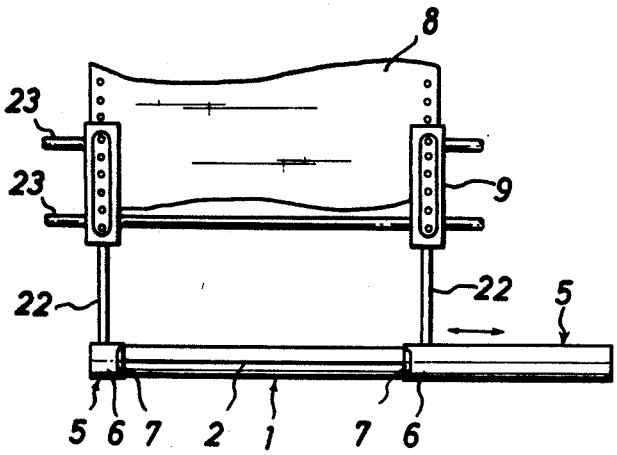
FIG. 3 is a plane view showing an embodiment of the electrostatic shields formed integral with corresponding tractors.

FIG. 3 shows an embodiment where electrostatic shields 5 are arranged integral with a tractor 9 adapted as a feed mechanism for feeding the recording paper 8. In this embodiment the electrostatic shields 5 are joined to the corresponding tractor 9 by a coupling bar 22. Numeral 23 denotes guide shafts for the tractor 9.

For setting the recording paper 8 in the printer, usually the operation of adjusting said elements to the width of the recording paper 8 is made by removing the tractors 9. But, if the electrostatic shields 5 are integrally joined to the respective tractors 9 as shown in FIG. 3, proper positioning of the electrostatic shields 5 can be accomplished automatically with setting of the recording paper 8.

Figure 4:
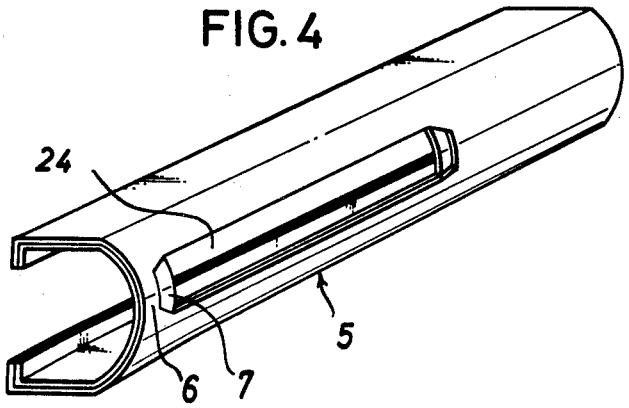
FIG. 4 is a perspective view showing another embodiment where the electrostatic shield is designed in the form of a mask.

FIG. 4 shows another embodiment of electrostatic shield 5 which is designed in the form of a mask having a window 24. There are prepared many such shields having windows with different widths, and a suitable one is selected in accordance with the width of the recording paper used. This electrostatic shield is held in position by the back bar 1 and may be detached when so desired.

Although each said electrostatic shield is disposed between the recording paper 8 and back bar 1 in the said embodiments, it may be placed between the recording paper 8 and the stream of ink mist 20 to provide the same effect.

Figure 5:
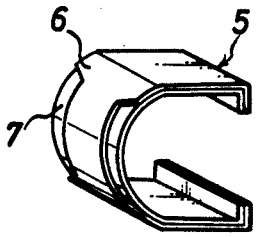
FIG. 5 is a perspective view of an electrostatic shield designed for use with recording paper having sprocket holes in the center.

In the foregoing embodiments, the electrostatic shields are adapted to cover both sides of the recording paper 8, so in case of using a recording paper having a sprocket hole or holes in the center, it needs to additionally provide a small-sized electrostatic shield 5 such as shown in FIG. 5, whereby to prevent electrically charged dust from flying out from such sprocket hole or holes toward the aperture board.

Although the insulating plate 7 of each electrostatic shield 5 is made of polyamide in each of the above-described embodiments, it is also recommendable to use Teflon or other insulating plastic materials. Also, the conductor plate 6 used in the described embodiments is the one prepared by applying hard chrome plating on a copper plate, but other materials may as well be employed. It is to be also noted that each electrostatic shield 5 is very thin in wall thickness as noticed in FIGS. 1, 4, and 5.

It will be further noticed that the conductor plate 6 of each electrostatic shield 5 is partly cut out to expose a part of the insulating plate 7. This is intended to prevent discharge from occurring between the first electrode 2 and the conductor plate 6.

As described above in detail, the present invention provides an improved ink mist type high speed printer mechanism featuring adaptation of electrostatic shield means disposed between the stream of ink mist and the back bar so as to cover all the exposed parts outside of the desired printing space, whereby even if insulating or conductive dust should deposit on the first electrode of the back bar, such dust is inhibited from flying out toward the aperture board, thus keeping said board free from deposition of ink mist particles during the printing operation.

What is claimed is:

1. In an ink mist type high speed printer comprising a first electrode and a second electrode between which a high voltage is applied, an aperture board disposed between said first and second electrodes and adapted to selectively control passage of ions generated from the second electrode in accordance with information of the characters to be printed, and means for generating a stream of ink mist type between said aperture board and first electrode, wherein the ink mist particles are electrically charged by the ions which have passed said aperture board and the charged ink mist particles are attracted to the first electrode to print characters on a recording paper placed on said first electrode, the improvement comprising electrostatic shields disposed between said first electrode and the stream of ink mist to prevent the existence of an electric field between said first electrode and said aperture board, said electrostatic shields being composed of an insulating plate and a conductor plate, said electrostatic shields covering the parts outside of the printing space of the recording paper, and the part of first electrode not covered with the recording paper to prevent conductive materials from adhering to the reverse side of said recording paper.

2. An ink mist type high speed printer as set forth in claim 1, wherein each of said electrostatic shields is arranged slidable on a back bar provided with the first electrode.

3. An ink mist type high speed printer as set forth in claim 1, wherein each of said electrostatic shields is arranged movable integrally with a corresponding tractor means adapted for feeding the recording paper.

4. An ink mist type high speed printer as set forth in claim 1, wherein a mask-shaped electrostatic shield having a window of a desired width is detachably secured to the back bar.

* * * * *